US005666630A

United States Patent [19]

Zoltner et al.

[11] Patent Number: 5,666,630

[45] Date of Patent: Sep. 9, 1997

[54] UNLOAD WHILE RUN APPARATUS FOR A COPIER/PRINTER

[75] Inventors: John D. Zoltner, Rochester; Gary A. Kelpin, Fairport, both of N.Y.

[73] Assignee: Xerox Corporation, Stamford, Conn.

[21] Appl. No.: 656,816

[22] Filed: Jun. 3, 1996

[51] Int. Cl.[6] ..... G03G 15/00

[52] U.S. Cl. ..... 399/405; 271/207

[58] Field of Search ..... 399/361, 381, 399/397, 405; 271/207, 213, 214, 278, 279, 287, 292

[56] References Cited

U.S. PATENT DOCUMENTS

| | | | |
|---|---|---|---|
| 3,820,777 | 6/1974 | Reehil | 271/155 |
| 4,008,957 | 2/1977 | Summers . | |
| 4,153,242 | 5/1979 | Mizuma . | |
| 4,858,909 | 8/1989 | Stemmle | 271/207 X |
| 4,995,602 | 2/1991 | Nakadai et al. | 271/207 |
| 5,038,169 | 8/1991 | Marincic et al. . | |
| 5,531,430 | 7/1996 | Tokunoh | 399/405 X |
| 5,613,672 | 3/1997 | Tanaka et al. | 271/207 |

OTHER PUBLICATIONS

Xerox Disclosure Journal, vol. 9, No. 2, Mar./Apr. 1984 pp. 113, 114.

*Primary Examiner*—Sandra L. Brase
*Attorney, Agent, or Firm*—William A. Henry, II

[57] ABSTRACT

A device that allows an operator to unload copy sheets from an output tray of a machine, keep the machine running, and maintain integrity of the copy sheet stack. The output tray is slid to the right with respect to the front of the machine to allow the operator to unload the copy sheet stack. When slid to the right, an 'X-shelf' is unfolded to hold the stack of continual copy sheet output. After the tray is emptied, it is slid to the left and back into the original position. The sheets on the 'X-shelf' fall into the output tray and the job continues uninterrupted.

21 Claims, 6 Drawing Sheets

UNLOAD WHILE RUN APPARATUS FOR A COPIER/PRINTER

BACKGROUND OF THE INVENTION

This invention relates to copier/printers, and more particularly, to a novel catch tray for copier/printers that enables an operator to unload the catch tray while copy sheets continue entering the tray.

High speed xerographic reproduction machines and printers, such as the Xerox DocuTech® 135 and Xerox® 5090 produce copies at a rate in excess of several thousand copies per hour, and therefore, the need to provide a readily and continuously available catch tray for the copies is paramount. It is known that the number one operator requirement of a high production machine is to keep the machine running in order to maximize productivity. Heretofore, when the external catch tray that is mounted on top of the machine was full of copy sheets the machine had to be stopped until the catch tray could be emptied by an operator thereby wasting valuable machine operation time. This arrangement is especially significant in high speed reproduction machines where sustained uninterrupted operation is necessary if high throughput speeds are to be achieved.

PRIOR ART

A copier/printer that must be stopped to empty an external catch tray 48 is shown in U.S. Pat. No. 5,038,169.

U.S. Pat. No. 4,008,957 discloses an electrostatic reproduction machine that includes plural paper feeding trays to permit switchover from a first tray to a second tray upon depletion of sheet feeding from the first tray.

U.S. Pat. No. 3,820,777 discloses an electrostatic reproduction machine having an apparatus for regulating the position of an auxiliary elevator assembly. The auxiliary elevator assembly includes copy sheets stacked thereon that are selectively transported to the reproduction machine depending on exhaustion of copy sheet feeding from a main elevator assembly.

In U.S. Pat. No. 4,153,242 two carriages with copy sheets thereon are shown with one of the carriages adapted to be loaded with copy sheets while copy sheets on the other carriage are being consumed.

A copy handling module is disclosed in the Xerox Disclosure Journal, Vol. 9, Number 2, March/April 1984, pgs. 113 and 114 that has the capability of feeding paper continuously while an operator has access to the main or auxiliary paper supply tray for replenishing purposes.

SUMMARY OF THE INVENTION

The present invention contemplates a new and improved copy sheet catch tray of a machine that facilitates removal of copy sheets from the catch tray while the machine continues to run.

According to the present invention a multi-positionable copy sheet catch tray is adapted to be moved to a first copy sheet support position to initially receive copy sheets on a first portion thereof as they exit a copier/printer until the first portion of the catch tray is full and moved to a second copy sheet support position which positions the catch tray to catch incoming sheets on a second portion of the catch tray while copy sheets are simultaneously being removed from the first portion of the catch tray. Once copy sheets are removed from the first portion of the catch tray, it is moved back to the original position with incoming copy sheets now being caught in the first portion of the catch tray.

BRIEF DESCRIPTION OF THE DRAWINGS

For a better understanding of the invention, as well as other objects and further features thereof, reference is made to the following drawings.

While the present invention will be described in connection with a preferred embodiment thereof, it is intended to cover all alternatives, modifications, and equivalents as may be included within the spirit and scope of the invention as defined by the appended claims.

DETAILED DESCRIPTION OF THE INVENTION

Reference is now made to the drawings where they are for the purpose of illustrating a preferred embodiment of the invention and not for limiting the same. The various processing stations employed in the printing machine illustrated in FIG. 2 will be briefly described.

The following terms as they are used in the specific example here are hereby defined. User interface, in this case the interactive CRT 70, or liquid crystal or other operator control console display panel and touch area or switch inputs is connected to a system controller or ESS. It may also be called a UIT or User Interface Terminal. The UI is where document handling, or finisher or other machine functions or modes are programmed in by the operator. The disclosed system can be used to determine, for example which of the five document handling modes (Recirculating Document Handler (RDH), (Semi-Automatic Document Handler (SADH), Computer Forms Feeder (CFF), Platen, and Book copying) the operator is trying to use for scanning. E.g., document scanning in Book Mode or CFF Mode is "selected" by the operator at the UIT in this example. ESS is the Electronic Sub-System or system control. IIT is the Image Input Terminal, also called a scanner in this example, but it does more than just image scan here. (Another term for this is EFE or Electronic Front End). IOT is the Image Output Terminal, which writes or prints (with a laser beam) the marks on the (copy) paper. DH is the overall Document Handler, or feeder, also referred to hereinbelow as the "UDH" or universal document handler with both an RDH document stacking try input and a SADH/CFF document input into which either computer form web (usually fanfold) feeding (CFF) or large or other individual documents may be loaded and fed.

Figure 1:
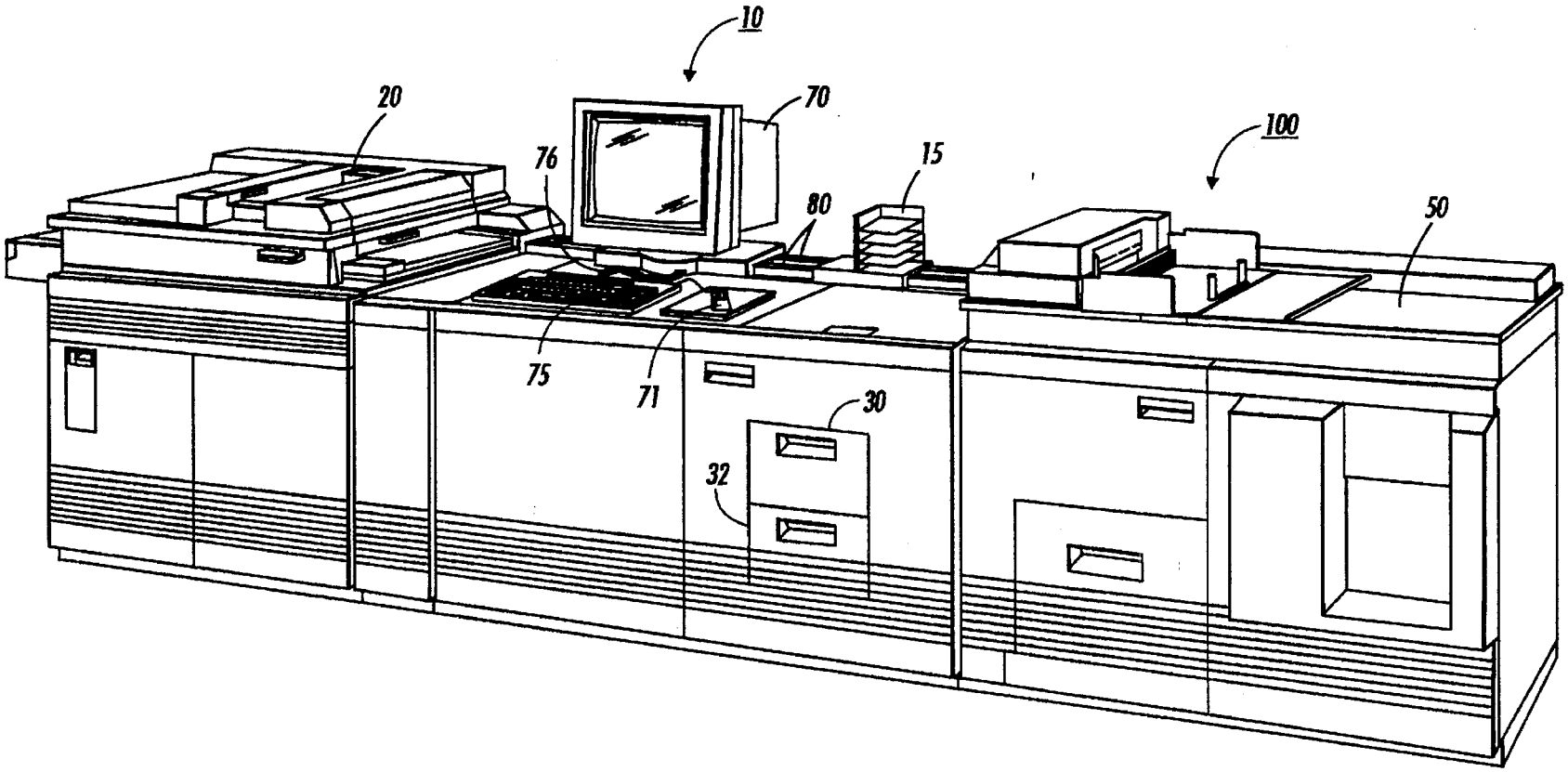
FIG. 1 is a schematic side view of a printer that incorporates the novel catch tray of the present invention.

As disclosed in FIG. 1, the printer 10 and its original UDH document presentation system 20 may be like that disclosed in Xerox Corporation U.S. Pat. No. 4,782,363. Printer 10 includes an ESS and IOT as an electronic document imaging system and a laser scanning system imaging a photoreceptor. Alternatively, this may be a conventional optical imaging system. As discussed above, operator inputs and controls and machine internal controls and operator displays and "prompts" or instructions are provided in a controller with displays. The document handler may also be like that in Xerox Corporation U.S. Pat. No. 4,579,444, and the finisher 50 disclosed herein is like that shown and described in Xerox Corporation U.S. Pat. No. 4,782,363, and its cross-referenced applications.

Here, in printer 10 of FIG. 1, a generally conventional xerographic system (not shown) is included with clean copy sheet trays 30 and 32 feeding unimaged copy sheets through a paper path to be imaged at a transfer station (not shown) of engagement with a photoreceptor (not shown) and subsequently transported to readily accessible top tray 100 or to finisher 50 where they are stacked bound or stapled. UI 70 is movably mounted on tracks 80 with an input keyboard 75 communicatingly connected with it through a connection 76. A mouse 71 is also connected to the UI. A work organizer 15 is positioned on top of the printer for operator convenience.

To satisfy the requirement of high production customers, printer 10 includes a top mounted copy sheet output tray 100 in FIG. 1 that facilitates unloading copy sheets from one portion of the tray while a second portion of the tray simultaneously accepts continuously fed copy sheets from the printer. This is accomplished by including a selfstoring auxiliary or 'X-shelf' in one portion of the tray that is to be extended into copy sheet receiving position as a copy sheet receiving portion of the tray is pulled out for emptying. After the copy sheet receiving portion of the tray is unloaded, and pushed back into place, prints or copy sheets that have accumulated on the extended 'X-shelf' are allowed to fall down neatly into the main output tray. The 'X-shelf' neatly pivots back into its folded storage position to be ready for the next unloading operation.

Figure 2:
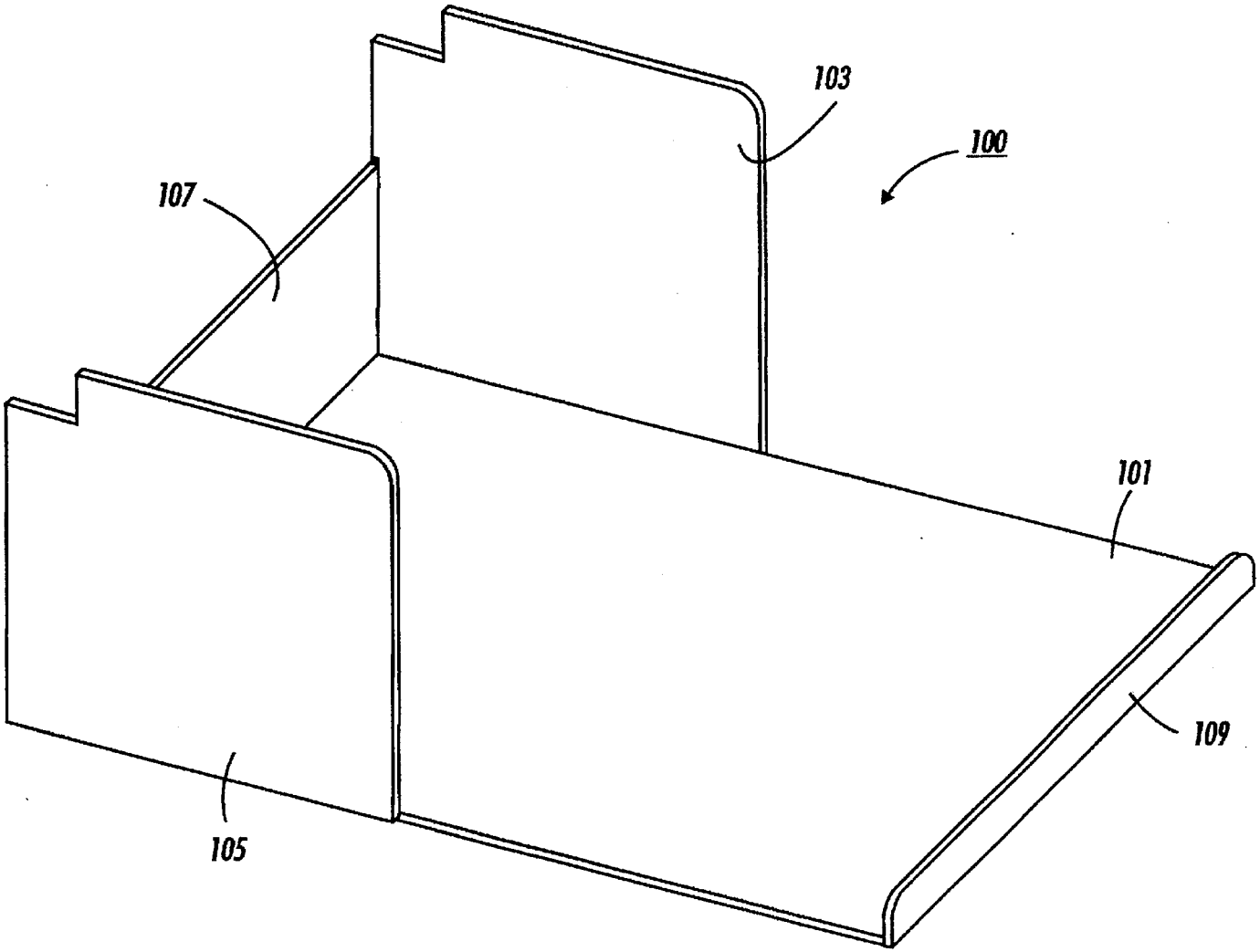
FIG. 2 is a perspective view of the main frame of the catch tray of FIG. 1.
Figure 3:
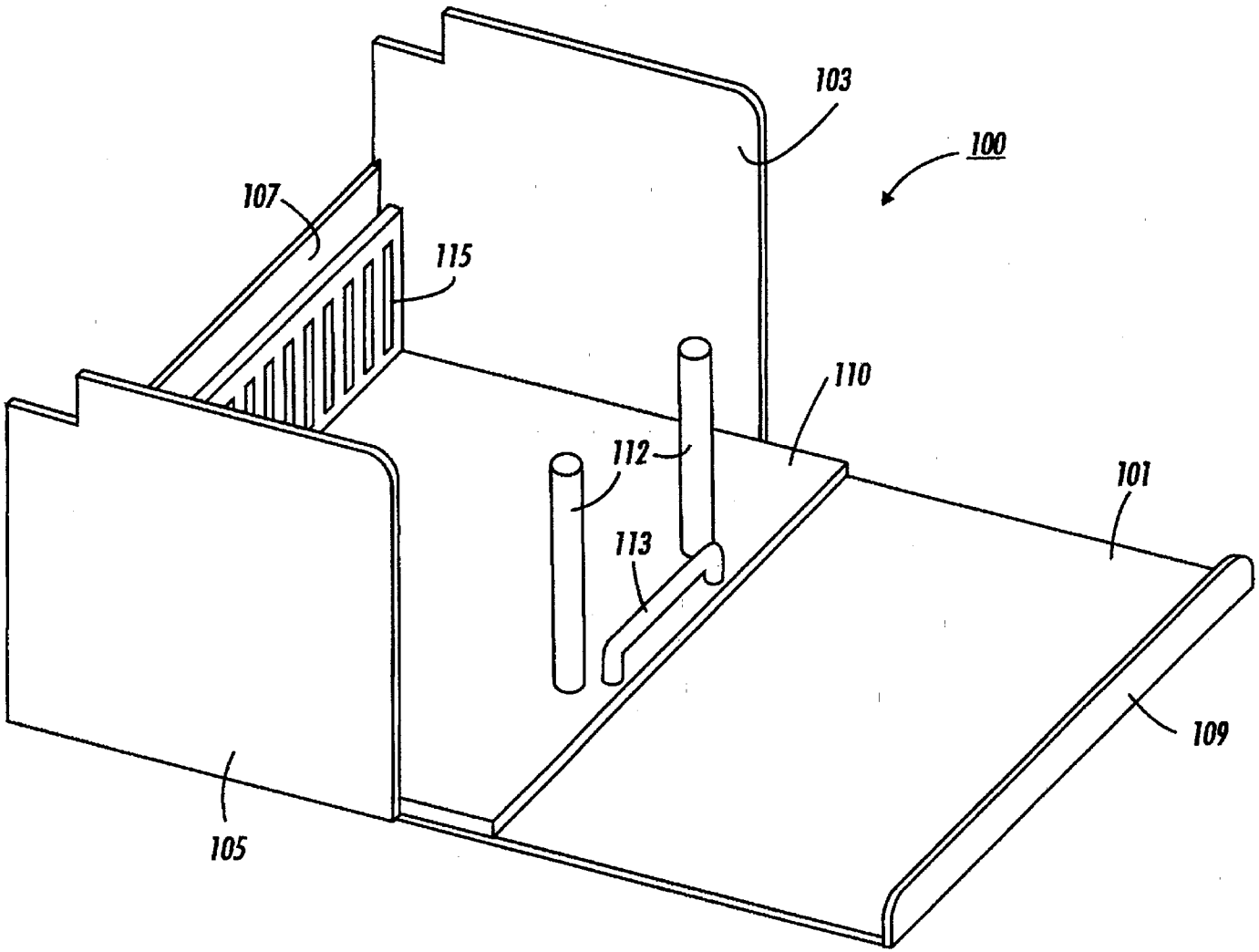
FIG. 3 is a perspective view of the completely assembled catch tray of FIG. 1 including a perforated auxiliary tray storage panel.
Figure 4:
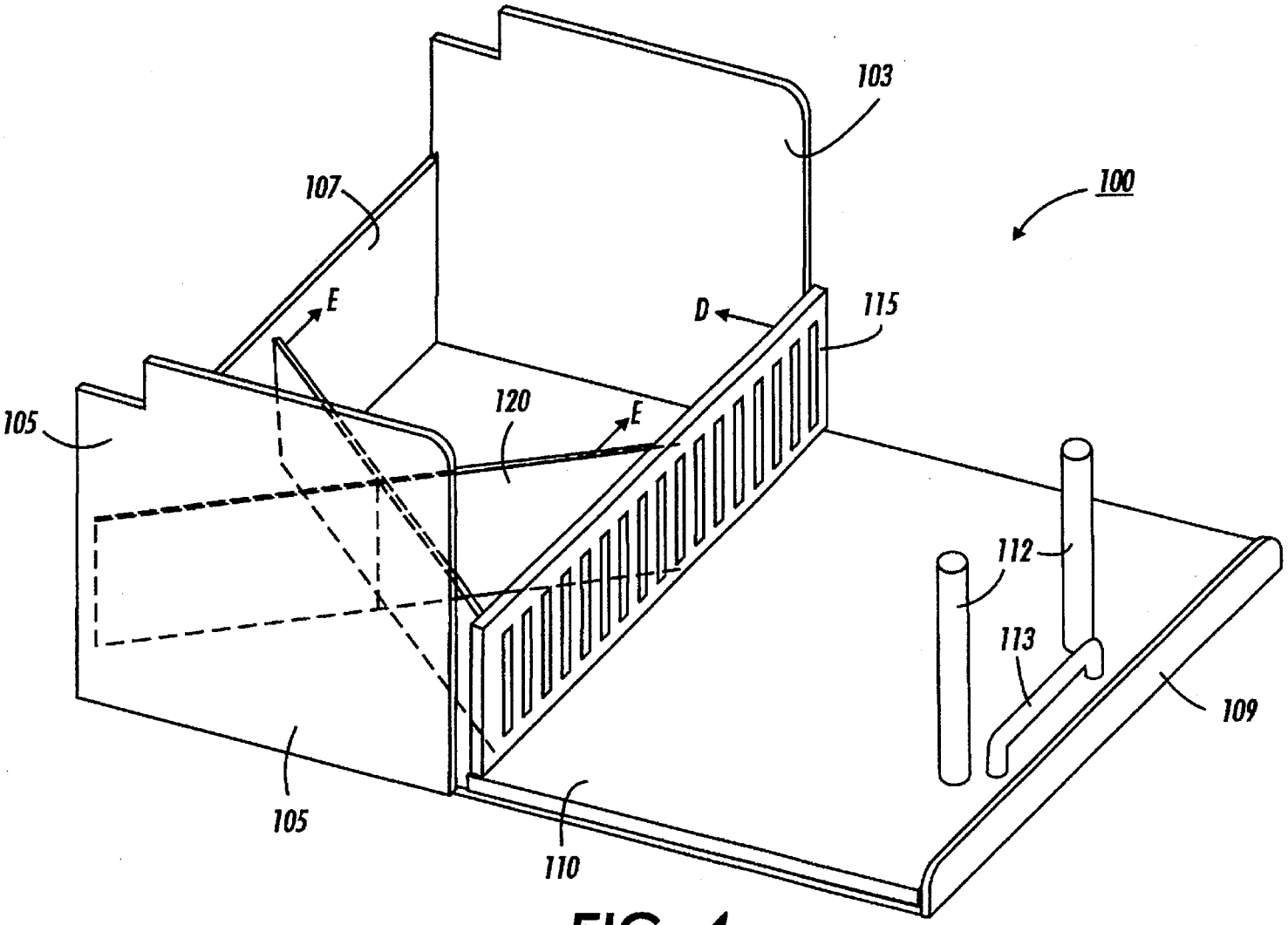
FIG. 4 is a perspective view showing the catch tray of FIG. 3 with the main copy sheet receiving tray slid to the right.

More specifically, output tray 100 of FIG. 2 comprises a main frame that consists of a base member 101 having a stationary front guide 105 and an adjustable rear guide 103 that is used to accommodate varying copy sheet sizes. To the left of the copy sheet guides is an end member 107 and a stop member 109 at the extreme right hand end of base 101. An assembled catch tray is shown in FIG. 3 that includes a sliding copy sheet receiving tray 110 that has a slotted sheetmetal guide 115 at one end thereof to the left as viewed in FIG. 3 and a plurality of vertical guides 112 to the right and a handle 113 for sliding the sliding tray back and forth. Attached to the left of sliding tray 110 is an extendible 'X-shelf' 120 as shown in FIG. 4 that folds into a 'rest' inside the sheetmetal guide 115 when sliding tray 110 is in the receiving position and extends to the right to form a temporary stacking shelf when sliding tray 110 is moved to the right as viewed in FIG. 4 to an unloaded position.

Figure 5:
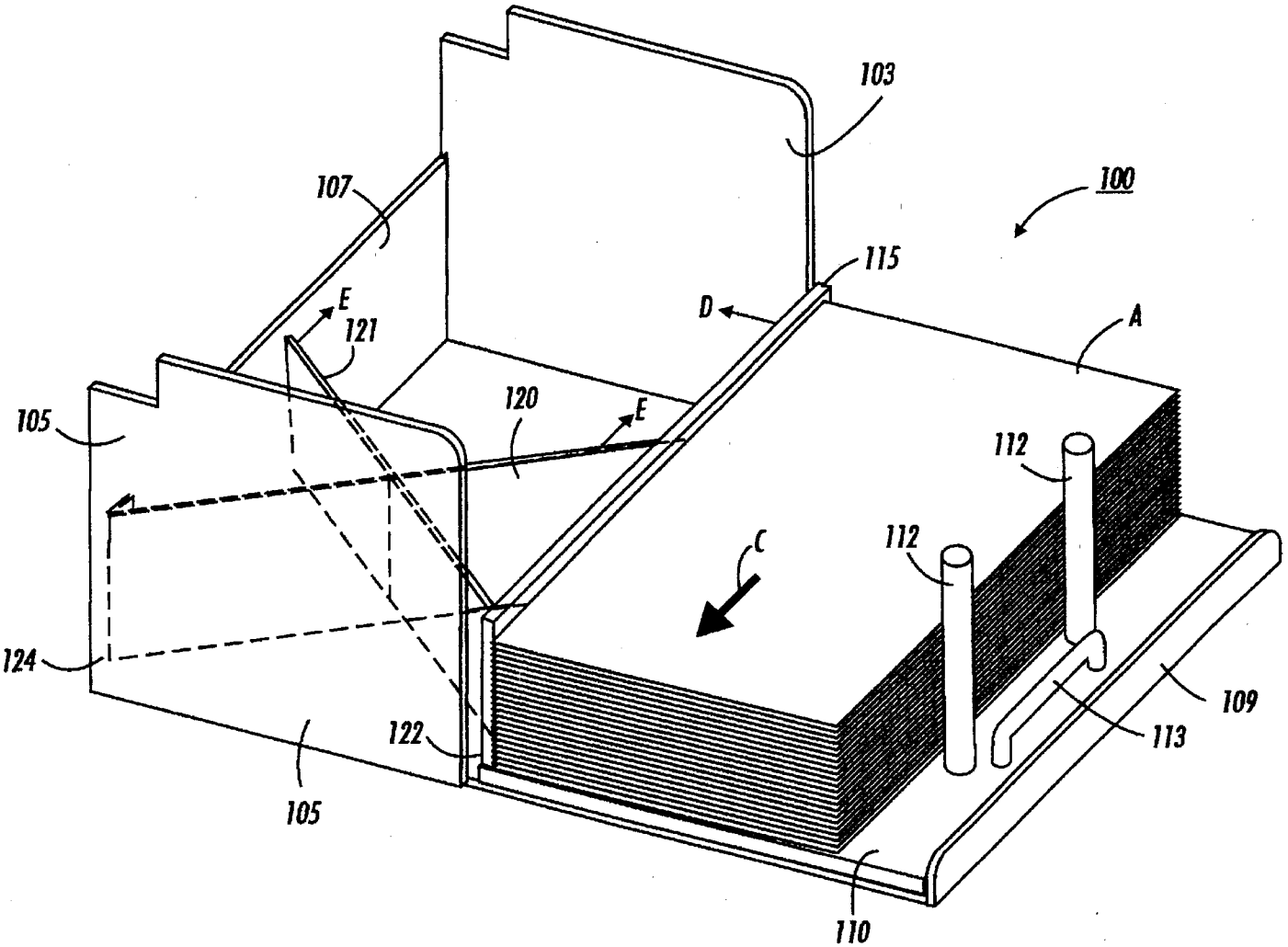
FIG. 5 is a perspective view of the catch tray of FIG. 4 showing a paper stack on the main copy sheet receiving tray ready to be unloaded in the direction of the arrow.
Figure 6:
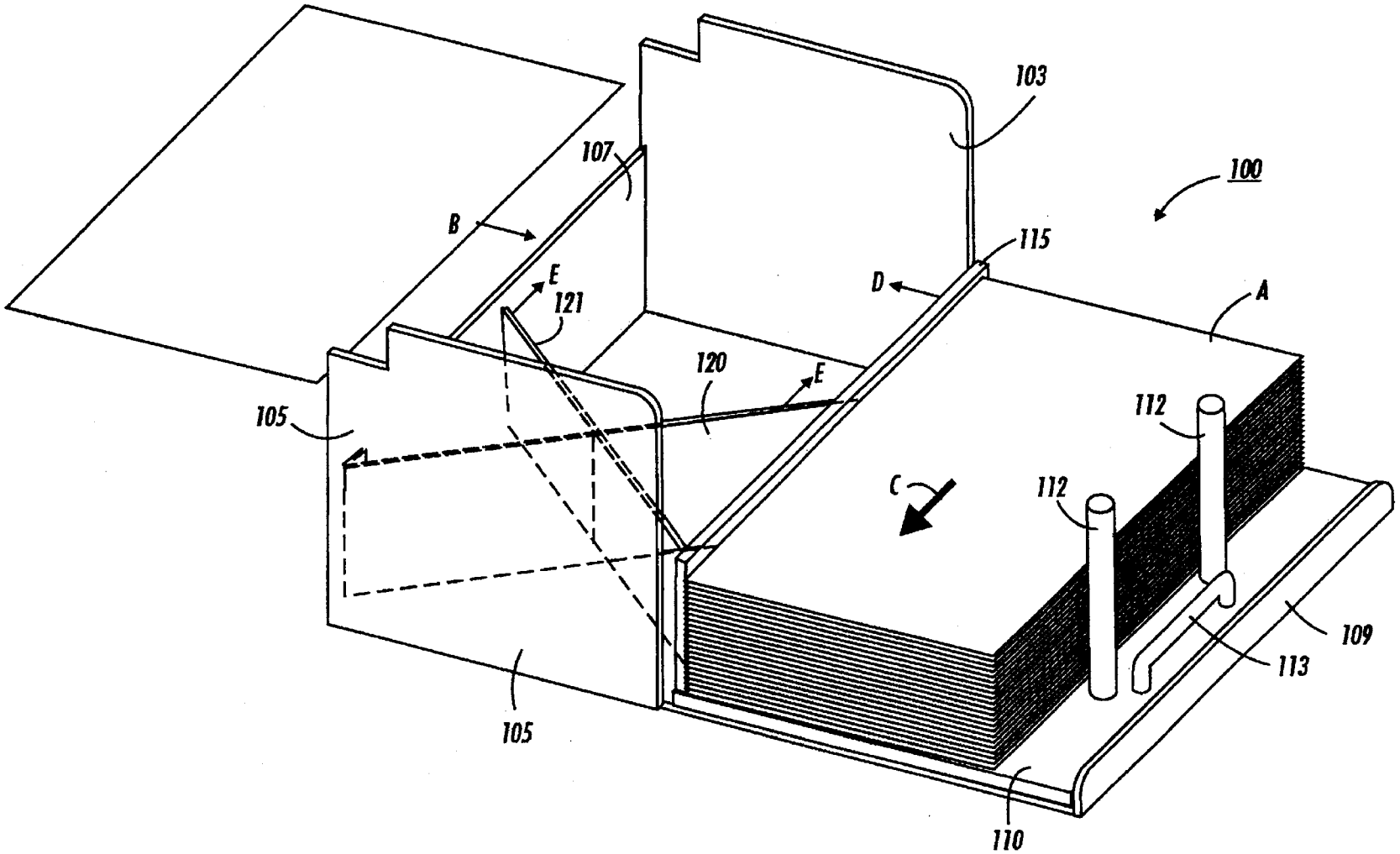
FIG. 6 is a perspective view of the catch tray of FIG. 5 showing copy sheets being deposited on an auxiliary shelf.

As shown in FIG. 5, main copy sheet receiving or sliding tray 110 has a stack of copy sheets "A" stacked thereon for removal in the direction of arrow "C" with 'X-shelf' 120 being extended to its fullest position after having been pivoted about fixed pivot points 122 and 124. Movement of main copy sheet receiving tray 110 to the left in the direction of arrow "D" causes perforated guide 115 to force 'X-shelf' 120 to collapse in the direction of arrows "E". The top surface of 'X-shelf' 120 is slightly lower than the height of guide 115. Sliding main tray 110 to the right as shown in FIG. 6 unfolds 'X-shelf' 120 to support incoming paper flow "B". Printer 10 includes conventional rolls (not shown) that decelerate as each copy sheet exits into tray 100 and thus allows copy sheets to settle on top of 'X-shelf' 120 and top of guide 115 without the need for a registration wall or stop member.

Operation of printer 10 fills up tray 100 creating an urgency to unload main copy sheet receiving tray 110 to prevent an overload sensor from stopping the machine at approximately 500 prints. To accomplish this, an operator will simply grasp handle 113 and pull the filled receiving tray to the right to a stop 109. This automatically extends 'X-shelf' linkage the correct distance to the right which forms a temporary platform for copy sheets that are coming out of the machine to stack thereupon. Flat 'X-shelf' 120 could be made from any suitable materials, such as, plastic, sheetmetal, etc. The operator then unloads the receiving tray in the direction of arrow "C" and pushes the empty receiving tray back to the left to its original position. This action causes the copy sheets piling onto the 'X-shelf' to slide neatly down into the main receiving tray with no loss in copy sheet sequence or productivity. One enabler for this unload while running sequence is the use of printer output rolls that accelerate, then decelerate, placing each copy sheet neatly in place as opposed to sending each copy sheet flying against an end stop. The result is a situation in which an operator can keep the printer running long enough to finish a given job before he/she has to experience the relatively lengthy pause required for a high volume printer to compose itself before it resumes printing.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a copier/printer wherein a viewable image is formed on copy sheets that are forwarded to a catch tray for receiving the copy sheets as they exit the copier/printer, the improvement that enables removal of a stack of copy sheets from the catch tray while other sheets are entering the catch tray, comprising:

a main copy sheet receiving tray adapted for movement from a first copy sheet receiving position to a second and non-copy sheet receiving position for unloading a stack of copy sheets therefrom; and a temporary storage tray adapted to receive copy sheets for stacking when said main copy sheet receiving tray is moved to said second position and while said main copy sheet receiving tray is being unloaded.

2. The copier/printer of claim 1, wherein said temporary storage tray is collapsible.

3. The copier/printer of claim 2, wherein said temporary storage tray includes a plurality of upstanding members that are adapted to pivot about fixed points.

4. The copier/printer of claim 3, wherein said main copy sheet receiving tray includes a slotted wall.

5. The copier/printer of claim 4, wherein said upstanding members of said temporary storage tray are movably connected to said slotted wall.

6. The copier/printer of claim 5, wherein movement of said main receiving tray expands said temporary storage tray.

7. The copier/printer of claim 5, wherein said plurality of upstanding members of said temporary storage tray form and "X" when said main copy sheet receiving tray is extended.

8. The copier/printer of claim 7, wherein the height of said plurality of upstanding members is less than the height of said slotted wall.

9. The copier/printer of claim 1, wherein movement of said main copy sheet receiving tray from said second position to said first position causes copy sheet on said temporary storage tray to fall into said main copy sheet receiving tray.

10. A method for unloading copy sheets from a catch tray while copy sheets are simultaneously entering the catch tray, comprising the steps of:

a.) receiving copy sheets in a first portion of said catch tray located in a first position; and b.) sliding said first portion of said catch tray to a second position while simultaneously presenting a second portion of said catch tray to receive copy sheets while copy sheets are being removed from said first portion of said catch tray.

11. The method of claim 10, including the step of providing a slotted wall between said first and second portions of said catch tray.

12. The method of claim 11, including the step of connecting said second portion of said catch tray to said slotted wall.

13. A multi-positionable copy sheet catch tray that facilitates the unloading of one copy sheet stack from the catch tray while another copy sheet stack is simultaneously accumulating in the catch tray, comprising:

a slidable first copy sheet receiving portion for receiving a stack of copy sheets;

a device connected to said first copy sheet receiving portion wherein movement of said device in a first direction causes said first copy sheet receiving portion of said catch tray to slide from its sheet receiving position to a non-sheet receiving position; and a second copy sheet receiving portion that receives copy sheets while the stack of copy sheets is removed from said first copy sheet receiving portion in said non-copy sheet receiving position.

14. The multi-positionable catch tray of claim 13, wherein said second copy sheet receiving portion is initially in a folded configuration.

15. The multi-positionable catch tray of claim 14, wherein sliding of said first copy sheet receiving portion in said first direction simultaneously unfolds said second copy sheet receiving portion into a copy sheet receiving position.

16. The multi-positionable catch tray of claim 15, including a partition separating said first copy sheet receiving portion from said second copy sheet receiving portion.

17. The multi-positionable catch tray of claim 16, wherein said partition has holes therein for the passage of air therethrough.

18. The multi-positionable catch tray of claim 17, wherein said partition is attached to said first and second copy sheet receiving portions.

19. The multi-positionable catch tray of claim 18, wherein said second copy sheet receiving portion is collapsed into said partition when said first copy sheet receiving portion is receiving a stack of copy sheets.

20. The multi-positionable catch tray of claim 19, wherein said second copy sheet receiving portion includes a plurality of upstanding members that have less height than said partition.

21. The multi-positionable catch tray of claim 20, wherein said upstanding members are pivotable about a fixed point.

* * * * *